United States Patent [19]

Lundberg

[11] Patent Number: 4,580,517

[45] Date of Patent: Apr. 8, 1986

[54] VESSEL HAVING PARALLEL HULLS WITH 360 DEGREE ROTATABLE THRUSTERS

[75] Inventor: Thorsten Lundberg, Askim, Sweden

[73] Assignee: Gotaverken Arendal AB, Sweden

[21] Appl. No.: 582,803

[22] Filed: Feb. 23, 1984

[30] Foreign Application Priority Data

Apr. 3, 1983 [SE] Sweden ..... 83-01196

[51] Int. Cl.[4] ..... B63H 5/12

[52] U.S. Cl. ..... 114/144 R; 114/151; 114/61; 114/265; 440/53; 440/67; 440/79

[58] Field of Search ..... 114/61, 144 R, 264, 114/265, 151, 150, 166, 144 B; 440/42, 67, 66, 79; 60/221

[56] References Cited

U.S. PATENT DOCUMENTS

| | | | |
|---|---|---|---|
| 2,655,891 | 10/1953 | Gorski | 440/67 |
| 3,487,805 | 1/1970 | Satterthwarte et al. | 440/67 |
| 3,771,481 | 11/1973 | Goren et al. | 114/265 |
| 4,310,319 | 1/1982 | Fuller | 114/166 |
| 4,436,050 | 3/1984 | Liden | 114/265 |

FOREIGN PATENT DOCUMENTS

| | | | |
|---|---|---|---|
| 2337534 | 4/1977 | Fed. Rep. of Germany | 114/61 |
| 0110697 | 8/1980 | Japan | 114/61 |

*Primary Examiner*—Galen L. Barefoot
*Assistant Examiner*—Edwin L. Swinehart
*Attorney, Agent, or Firm*—Wegner & Bretschneider

[57] ABSTRACT

The location of azimuth thruster propellers at the parallel hulls of semisubmersible offshore vessels, is arranged so the water jet from a propeller at one hull, which is occasionally directed towards the adjacent hull will pass mainly below last-mentioned hull. When thruster propellers are arranged in pairs the bottoms of the hulls will preferably be inclined upwardly/outwardly within the portion around a thruster propeller located outside of a longitudinal middle plane through the hull. In order to facilitate the docking of the vessel, the bottom plating in the fore and aft bodies of the hulls, where the thruster propellers are mounted, should be raised sufficient to prevent the propellers projecting below the base lines of the hulls.

2 Claims, 6 Drawing Figures

FIG. 3
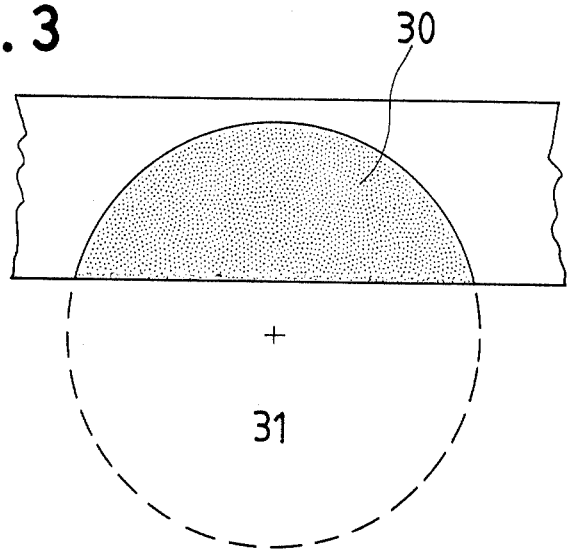
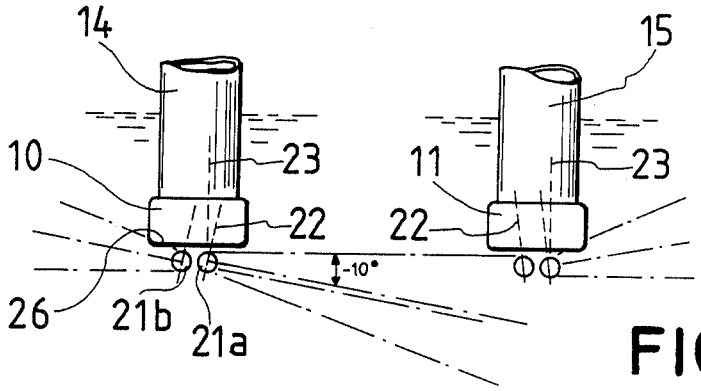
FIG. 4
FIG. 5
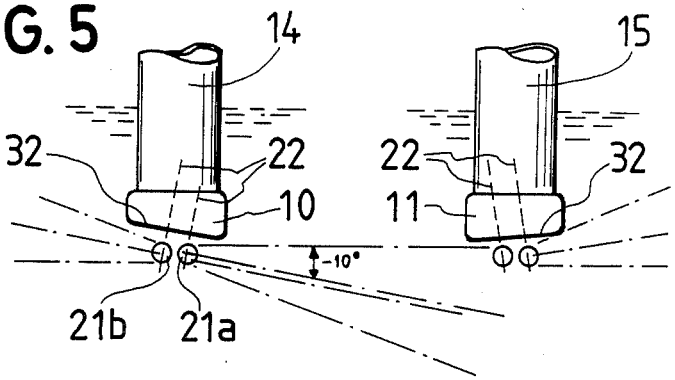

VESSEL HAVING PARALLEL HULLS WITH 360 DEGREE ROTATABLE THRUSTERS

BACKGROUND OF THE INVENTION

The present invention refers to semisubmersible offshore vessels having parallel twin underwater hulls, provided with propulsion machinery comprising a number of azimuth thruster propellers.

Each thruster propeller is rotatable 360° in relation to a vertical axis, and is used for propulsion as well as for steering. A very important function of these propellers is to retain the vessel in a desired working position during operation.

These thruster propellers are necessarily mounted below the bottom plating of the hulls.

During a voyage the action of wind, waves and streams may make it necessary to direct one or more propellers at one of the hulls, so the water jet, or jets will be directed towards the other hull. Such a directing of one or more propellers will be especially noticeable, when it is desirable to retain the vessel in a desired position. The portion of a water jet hitting the side of the adjacent hull will of course apply a force upon the latter, which causes an undesirable steering action.

The fact that the thruster propellers will project from the bottom plating of the hulls will cause problems during docking and when the vessel is brought into a harbour with a limited water depth.

SUMMARY OF THE INVENTION

In order to remove the drawbacks above referred to it is now proposed that the rotational axis of the housing of each thruster propeller is inclined in relation to the vertical axis so the water jet from a thruster propeller at one hull, occasionally directed towards the adjacent hull will mainly pass below that hull.

The thruster propeller axis is preferably inclined downwardly/outwardly in relation to the vertical axis.

In order further to improve the thruster action, the substantially plane bottom of a hull, at least in the portion thereof adjacent to a thruster propeller may be inclined upwardly/outwardly.

The disadvantage with the thruster propellers projecting below the bottom of the hull, and thus preventing docking if the propellers are not dismounted, may be counteracted by raising the plating in the forebody as well as in the aft body of each hull sufficiently above the base line of the hull, so any thruster propeller fitted within a raised portion will remain above the base line. The thruster propeller axis is then preferably inclined outwardly/downwardly in relation to a transverse plane.

With an offshore vessel having two thruster propellers adjacent to at least one of the columns carried by a hull, the thruster propellers are preferably located to opposite sides of a longitudinal middle plane and a transverse plane through the column.

In an offshore vessel having four columns and two thruster propellers at each of them, the thruster propellers located between the columns carried by the same hull are preferably located outside of a longitudinal middle plane through the hull, while thruster propellers located outside of the columns are loceted inside of said lonitudinal middle plane.

BRIEF DESCRIPTION OF THE DRAWINGS

FIG. 4 shows an end view of hulls having plane bottom plating and thruster propellers mounted in pairs, and FIG. 5 shows a modified embodiment for obtaining improved water flow from the outward propellers.

DETAILED DESCRIPTION

Figure 1:
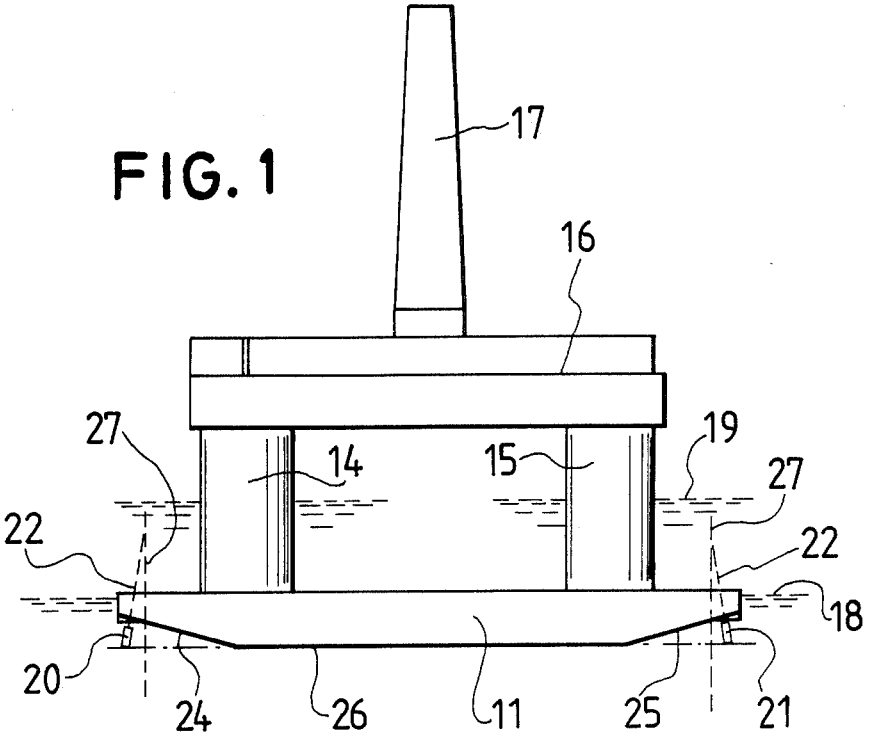
FIG. 1 shows an elevation of an offshore vessel fitted with thruster propellers according to the invention.

FIG. 1 shows, very schematically, an elevation of an offshore vessel suited for drilling or for production.

It is provided with two parallel underwater hulls 10 and 11 (of which ony one can be seen FIG. 1), which by means of four columns 12–15 carry an operating platform 16 enclosing workshops, housing for the staff, stores, etc. The platform further carries a drilling rig 17, or a derrick.

Each hull encloses a number of ballast tanks, and is defined by a deck, side plating, and a bottom plating, which is plane along a major portion of its length.

The water level for the vessel in transit is denoted at 18, and the water level during operation is denoted at 19.

In the fore, as well as in the aft body of each hull there is a thruster propeller 20, 21 or a pair of such propellers. In order to avoid disturbances by the propeller water jets being directed towards an adjacent hull the rotational axes 22 of the thruster propellers, in the manner illustrated in FIG. 4 are inclined downwardly/outwardly, in relation to a geometric vertical axis 23, sufficiently to ensure that the water jet will mainly pass below the hull. Roughly taken, half of the conus angle in the water jet will be 10°.

In order to make possible a docking of the vessel without removing the thruster propellers, the bottom plating 24, 25 of the fore and aft bodies of the hulls is raised sufficiently above the base line 26 of each hull to ensure that the propellers 20, 21 do not project below said base line.

In the present embodiment the thruster propeller axis is further inclined in relation to a transverse plane 27, preferably sufficient to bring the rotational axis of the propeller parallel to the adjacent portion of the bottom plating.

Figure 2:
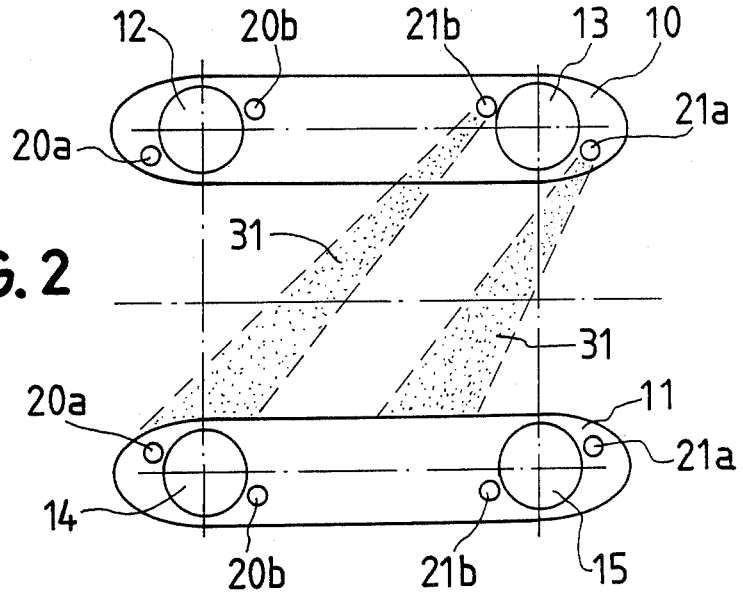
FIG. 2 shows a plan view of the twin hulls in which the positions of the thruster propellers have been slightly modified, compared with FIG. 1, FIG. 3 schematically illustrates how a portion of a water jet from one thruster propeller with a conventional arrangement hits upon an adjacent hull.

FIG. 2 shows a plan view of the hulls at a somewhat modified embodiment of the location of the thruster propellers. A pair of thruster propellers 20*a*, 20*b* is provided at each of the aft columns 12 and 14, and a pair of thruster propellers 21*a*, 21*b* is provided at each of the forward columns 13 and 15.

These propellers are located in portions of the bottom plating, being substantially plane. If the axis of a propeller housing in a conventional manner remains vertical the propeller water jet from a propeller at one of the hulls, say no. 10, would be conically enlarged sufficiently, when it reaches the other hull 11, to impinge thereon within the shaded portion 30 in FIG. 3. The impinging against the side of the hull 11 would exert an undesirable steering effect upon the hull.

As is evident from FIG. 4 the axis 22 of the housing of the thruster propeller is inclined sufficient to ensure that the propeller water jet 31 from the thruster propeller 21*a* at hull 10 will pass undisturbed below the bottom of hull 11.

Returning to FIG. 2 this shows two thruster propellers at each column. The area of a propeller water jet cone 31 at the opposite hull will of course depend upon how the propeller is directed.

The area will have its smallest size if the propeller is directed straight at the hull, and will increase as the angle of attack increases. Simultaneously the force applied by the water jet will be reduced due to the increasing distance between the propeller and the acutal area of the hull.

In order that the water jets shall disturb each other as little as possible the thruster propellers 20*b*, 21*b* located between the columns are fitted outside the longitudinal middle plane of the hulls, whereas the thruster propellers 20*a*, 21*a* located outside the columns are fitted inside said plane.

If the bottom plating of the hull within the portion where a thruster propeller is fitted, is plane the propeller jet from a propeller located outside of the longitudinal middle plane will hit the bottom plating adjacent to the side plating, when the propeller is directed outwards. This is indicated in FIG. 4.

In order to reduce this detrimental action it is advantageous to shape the bottom plating, at least in the portion thereof where a thruster propeller located outside the longitudinal middle plane is fitted, so the plating is inclined upwardly/outwardly in the manner indicated at 32 in FIG. 5.

Figure 6:
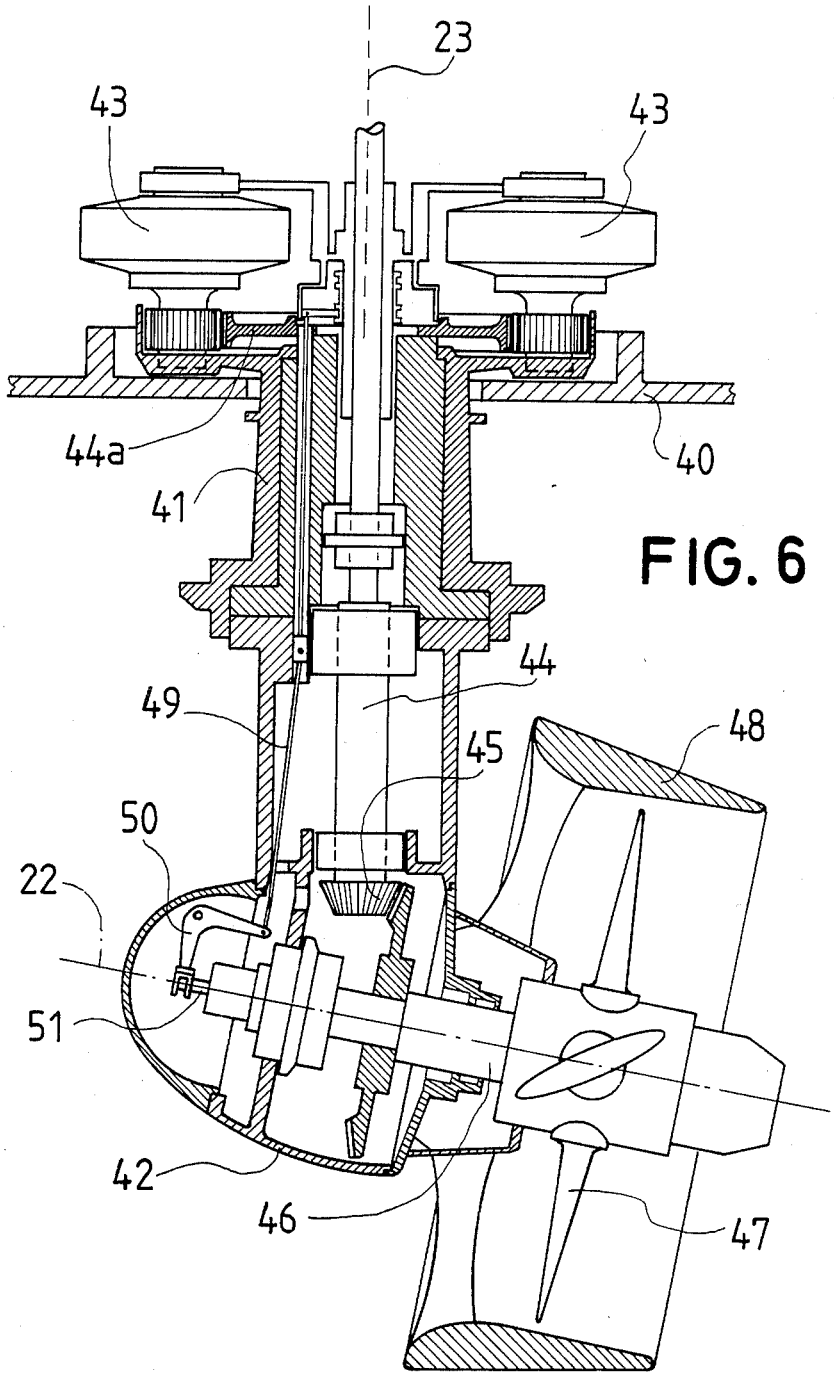
FIG. 6 shows, moe in detail a thruster propeller with an angle gearing.

FIG. 6 shows, more in detail, a modified embodiment of a thruster propeller arranged according to the invention. The bottom plating of the hull is denoted by 40, and in an opening therein a tubular casing 41 is fitted, at the lower end of which the propeller housing 42 is attached.

The combined casing 41 and housing 42 are rotatable 360° about the vertical axis 23, by means of hydraulic motors 43, driving upon a gear wheel 44*a* mounted upon the drive shaft 44.

An angle gearing 45 enclosing an angle bigger than 90° connects the vertical driving shaft 44 with the propeller shaft 46. The rotational axis for the propeller is, as before, denoted by 22.

The propeller is denoted by 47 and is, in a conventional manner, enclosed by a shroud ring 48. The blades of the propeller are adjustable, and the blade adjusting mechanism built into the hub of the propeller, is actuated by a link mechanism 49, 50, 51.

The embodiments described above and shown in the drawings are examples only of the invention, the details of which may be varied in many ways within the scope of the appended claims. The shape of the hulls as well as the number of columns may vary, and furthermore the number and the location of the thruster propellers may vary depending upon the requirements concerning propulsion and capacity of positioning the vessel which are imposed upon the thruster propeller machinery. What I claim is:

1. In a semisubmersible vessel comprising an operating platform carried by columns from two parallel hulls, each said hull forming a closed unit defined by a deck and side and bottom plating, each hull further carrying propulsion means including a number of 360° rotatable thruster propellers mounted in housings projecting from the hulls, the improvement comprising disposing said housings such that their rotational axes are inclined in relation to a geometric vertical axis sufficient to ensure that the water jet from any thruster propeller at one of said hulls, when directed at the other of said hulls will mainly pass below said other hull, at least two of said thruster propellers being located adjacent to at least one of said columns carried by a hull, said two thruster propellers being located to opposite sides of a longitudinal middle plane as well as to opposite sides of a transverse plane through said column.

2. A vessel according to claim 1, and having four columns and two thruster propellers at each said column, the improvement comprising the thruster propellers located between the columns carried by the same hull being located outside of a longitudinal middle plane through the hull, while thruster propellers located outside of the columns are located inside of said longitudinal middle plane.

* * * * *